United States Patent [19]

Davis et al.

[11] Patent Number: 4,907,506

[45] Date of Patent: Mar. 13, 1990

[54] METHOD AND APPARATUS FOR CONTROLLING SPRING RATE AND LEVERAGE IN A SCREEN PRINTING DEVICE

[75] Inventors: Terry W. Davis; James P. Gates, both of Glens Falls, N.Y.

[73] Assignee: R. Jennings Manufacturing Co., Inc., Glens Falls, N.Y.

[21] Appl. No.: 338,371

[22] Filed: Apr. 13, 1989

Related U.S. Application Data

[63] Continuation of Ser. No. 119,482, Nov. 12, 1987, abandoned.

[51] Int. Cl.[4] ..... B41F 15/10; B41F 15/34

[52] U.S. Cl. ..... 101/115; 101/127.1; 101/129

[58] Field of Search ..... 101/115, 126, 127.1, 101/128.1, 114, 123, 129; 16/298, 72; 403/118, 120, 145, 229; 267/225, 248, 173, 177

[56] References Cited

U.S. PATENT DOCUMENTS

| | | | |
|---|---|---|---|
| 270,368 | 1/1883 | Barlow | 267/173 X |
| 367,020 | 7/1887 | Barlow | 16/72 X |
| 1,908,984 | 5/1933 | Katz | 16/72 |
| 1,992,048 | 2/1935 | Temple | 403/229 |
| 2,704,510 | 3/1955 | Walsh, Jr. | 101/126 X |
| 2,955,813 | 10/1960 | Hume | 267/173 X |
| 3,427,964 | 2/1969 | Vasilantone | 101/115 |
| 4,266,476 | 5/1981 | Maloof | 101/126 X |
| 4,606,268 | 8/1986 | Jaffa | 101/115 |

FOREIGN PATENT DOCUMENTS

| | | | |
|---|---|---|---|
| 2648085 | 4/1978 | Fed. Rep. of Germany | 16/298 |
| 205093 | 8/1924 | United Kingdom | 101/126 |
| 272390 | 6/1927 | United Kingdom | 101/126 |

OTHER PUBLICATIONS

*Ranar* Manufacturing Compnay Brochure Entitled "Model P-110 Manual T-Shirt Printer", one sheet.

*Antec* Brochure "Screen Printing Equipment Engineered for the Hands", thirteen sheets.

Hopkins International brochure "1/C One Color Frames".

*Primary Examiner*—Clifford D. Crowder

*Attorney, Agent, or Firm*—Nixon & Vanderhye

[57] ABSTRACT

An adjustment device for a screen printing machine wherein the tension on pivotally mounted screen holding arms may be adjusted to accommodate screens of various sizes and weights. The adjustment device includes a vertically adjustable connector to which one end of a coil spring associated with a screen holding arm is connected. The adjustment device includes at least one bolt which mounts the connector for up or down movement upon rotation of the bolt, so that the connector, and spring, are moved relative to a horizontal plane containing the pivot axis of the screen holding arm. By suitably adjusting the spring connector via rotation of the bolt, the spring rate may be altered and leverage is created for moving the spring to up and down positions. An adjustment device for accomplishing similar results in used for gas compression cylinders extending between screen holding arms and the machine head.

31 Claims, 3 Drawing Sheets

METHOD AND APPARATUS FOR CONTROLLING SPRING RATE AND LEVERAGE IN A SCREEN PRINTING DEVICE

This is a continuation of application Ser. No. 07/119,482, filed Nov. 12, 1987, now abandoned.

BACKGROUND AND SUMMARY OF THE INVENTION

This invention relates to screen printing apparatus and, more specifically, to a device for controlling and adjusting the spring rate and leverage associated with the screen holding arms usually associated with such apparatus.

Printing machines in the screen printing industry typically print small cap images and larger T-shirt images. In most case, printers use wood or aluminum frames of various sizes, typically a 9"×12" for caps and a 20"×22" for T-shirts and the like. In the case of wood, typically a soft wood such as pine, which has the advantage of being light in weight, is employed in the frame construction, with individual frame sides generally about 1 inch thick and about 1½ inches wide.

There are instances, however, where oversize frames are required for even larger images such as for pant legs, sleeves, decorative banners, etc., and in those cases where more than one image is to be provided on a single screen. In such cases, the oversize frames are significantly heavier than the largest of the normally used frames, i.e., the 20"×22" frame. In fact, it is known to use 2×4's constructed from Kiln-dried hard wood in the construction of oversize frames. These larger frames have proven to be difficult and even unworkable, when used with conventional screen printing machines primarily due to their increased weight.

In a typical screen printing machine, a screen (or screen frame) holding arm is mounted for pivotal movement between a printing, or down, position to a non-printing, or up, position relative to a platen upon which rests the item to be printed. The screen holding arm is generally provided with a clamping or holding mechanism which grips a screen of the type described hereinabove. Most such machines employ extension springs extending between the machine head and a point intermediate the ends of the screen holding arm, to control movement of the screen and screen holding arm from the printing to the non-printing position and vice versa. Of course, these springs are designed to extend only to certain length, beyond which the spring is subject to permanent damage from plastic deformation. The springs currently in use in the screen printing industry are sufficient to handle the normal range of frame sizes up to the 20"×22" size, and even slightly larger. However, for substantially larger and heavier frames, these springs are not sufficient as explained below.

In conventional screen printing machines, using conventional screen sizes, the inner point of attachment of the spring, i.e., at the machine head, is generally slightly below the pivot point of the screen holding arm. Typically, when the screen is raised to a non-printing position (generally about 60° from horizontal) and released, it will remain in the raised position. At the same time, when the arm is lowered to a printing position, the arm will remain lowered, with the screen in contact with the item to be printed, so that the operator can use both hands to print the cap, T-shirt or other items.

When oversize frames are utilized in such machines, the weight of the frame overcomes the spring tension so that the frame will not stay in the up, or non-printing position. Thus, the operator must support the screen in the raised position to prevent it from falling to the lower, or printing position. This, of course, is an undesirable and even unworkable situation.

If larger, stiffer springs are used to accommodate these oversize frames, the overall flexibility of the machine is reduced because the operator cannot thereafter switch back to the smaller, lighter cap or T-shirt frames. This is because the larger, stiffer springs will keep the lighter frames in a normally biased upward position so that an operator would not be able to release the frame after lowering it into a printing position. It is, of course, important that the operator be able to free his hands to print the image when the frame is lowered. Thus, in the past, moving between extreme frame sizes thus involved a time consuming change of springs as well. In addition, the stiffer larger springs employed for oversize frames are typically made of hardened steel, and create a substantial risk of injury in the event of breakage.

Other approaches have been taken when utilizing the larger frames for controlling the movement of the screen holding arms. For example, compression rather than extension springs have been tried, as have pressurized compression gas cylinders. However, compression springs have usually not proven to be satisfactory and, in the case of gas cylinders, there typically is no ability to adjust the cylinders to change the rate at which the connecting (piston) rod extends or retracts within the cylinder.

Other manufacturers have employed turnbuckles attached to the end of the extension springs to regulate the tension, or extension, of the spring. It has also been attempted to employ four springs, rather than two, for each screen holding arm. Neither of these techniques has met with any significant degree of acceptance in the trade.

This invention broadly relates to improvements in screen printing machines in general, and in particular, to screen printing machines wherein extension springs, compression springs or gas compression cylinders are associated with screen holding arms, and may be adjusted simply and quickly to not only alter the spring rate, but to also provide a degree of leverage to facilitate movement of the screen holding arm between printing and non-printing positions and vice versa, so that the spring action can be made, in effect, uniform for virtually any frame. In other words, it has been discovered that by adjusting spring tension as well as the point of attachment of the springs or gas cylinder to the machine head relative to the plane of the pivot point of the screen holding arm, a conventional screen printing machine can accommodate normal as well as oversize screens without any necessity for time consuming spring changeover.

In addition, because of the adjustability provided by the invention, the hardened steel springs usually employed in prior art machines are not required. In fact, it is preferable that the coil springs in this invention be constructed of steel "piano" wire, which pose a considerably lesser degree of risk in the event of breakage.

Specifically, in one exemplary embodiment, the invention relates to a screen printing machines of the type comprising a printing head mounted on a base and carrying at least one screen holding arm. The arm is pivotally mounted to the head for movement about a horizontal axis such that the arm is movable downwardly toward an associated platen and upwardly away from the platen. There is also associated with each arm a pair of coil extension springs, arranged on either side of the arm, with first ends attached to the rotary head and second ends attached to the arm at a location intermediate the ends of the arm and spaced from the pivot axis.

A unique mechanism is provided in accordance with this exemplary embodiment for adjusting the coil extension springs in two respects. First, the mechanism allows the effective length of the spring to be altered, thereby changing the spring rate. Second, the mechanism effects vertical movement of the attachment point of the spring at the machine head above, below or within the horizontal plane passing through the pivot point of the screen holding arm, thereby changing the amount of leverage available to lift or lower the screen holding arm. In a single color printing machine, utilizing a single screen holding arm, each of the two associated extension springs would be provided with an adjustment mechanism as provided by this invention, while in a typical four color machine, four such mechanisms are employed to accommodate eight extension springs. It will be understood, of course, that the adjustment mechanism of this invention is equally applicable in machines with any number of screen holding arms.

Each extension spring is attached to the printing machine head adjacent the pivot pin for the screen holding arm via an adjustment connector which includes an eyelet formed at either end of an elongated throat portion. The connector throat portion extends horizontally between interior and exterior portions of the machine head. On the interior side, the inner eyelet is slidably received over a vertically extending, threaded bolt. The bolt itself is captured within said head for rotational movement with respect to the head, i.e., during rotation, the axial position of the bolt does not change.

The bolt threadably receives a pair of nuts, with the inner eyelet sandwiched therebetween and fixedly secured, as by brazing or the like, to each. The intermediate or throat portion of the connector, passes through a slot between two adjacent walls of the machine head. The outer eyelet of the connector receives a hook portion of an extension spring. In this way, rotation of the bolt causes the nut and the connector assembly to move upwardly or downwardly on the bolt, depending on the direction of rotation, and thus raise or lower the attachment point of the spring relative to the pivot pin.

It will be understood that a similar adjusting mechanism is provided with respect to the other extension spring on the other side of the screen holding arm.

In an alternative arrangement to this first exemplary embodiment of the invention, the spring adjustment technique as described above is applied to a four color machine where four screen holding arms are arranged at 90° intervals about a rotatable machine head. In this case, the machine includes four fixed platens, also arranged at 90° intervals about the machine head, enabling the screen holding arms to be rotated, successively, to the individual platens. In this embodiment, the spring adjustment mechanism is identical to that provided for the single color machine, but here, four of the adjustment bolts are provided, each accommodating two extension springs. Because of the arrangement of screen holding arms at 90° intervals, it is convenient to have each bolt adjust one coil extension spring associated with each of two adjacent and mutually perpendicular screen holding arms as disclosed in greater detail hereinbelow.

As a result of this invention, the screen printing machine operator can adjust the spring rate and leverage available for lifting the screen holding arms to obtain the desired tension and control of the arm, regardless of the frame size. Thus, for the normal 9"×12" or 20"×22" frames, the operator would, through rotation of the two or more adjustment bolts, maintain the inner point of attachment of the extension springs just below the plane of the pivot point of the screen holding arm. In this configuration, the machine operates on the usual way so that, in the down or printing position, the operator may release the arm and therefore free his hands for printing the image. At the completion of the printing operation, the operator may then raise the screen holding arm to an up, or non-printing position and the arm will be held in the raised position by the extension springs.

When oversize frames are to be used, the operator simply rotates the adjustment bolts to raise the point of attachment of the spring into, or just above the plane of the pivot point of the screen holding arm. This not only elongates the spring to increase the spring rate, but also increases the leverage available for raising the arm. Now, even the larger, oversize frames will be maintained in the upper position when released, and the weight of the frame will cause the frame to remain lowered when in the printing position, allowing the operator to free his hands for printing the image.

It is to be understood that various settings for frames of different sizes and weights may be determined empirically and recorded in chart form, enabling the operator to repeatedly adjust the springs precisely according to frame size and weight, with the aid of scales or rules applied to the machine head adjacent the adjustable spring connectors.

In another exemplary embodiment of the invention, a compression gas cylinder is utilized to control movement of the screen holding arm. In this embodiment, the screen holding arm is also mounted for pivotal movement relative to the machine head. However, the pivot pin about which the arm rotates is mounted for vertical sliding movement. At the same time, a piston and cylinder unit is fixedly mounted at first and second pivot points on the screen holding arm and machine head, respectively. The second pivot point on the machine head is fixed, just beneath a pair of vertically oriented slots in which the pivot pin of the screen holding arm is slidably mounted. In this manner, the "spring rate" of the cylinder, as well as the available leverage, may be altered in much the same manner as the above described extension spring embodiment.

It will be further understood that this second exemplary embodiment is equally applicable to four-color, or four-head machines as well.

It should also be understood that compression springs fixed between the screen holding arm and head may be used in place of the compression gas cylinder, with the screen holding arm pivot pin adjustable as described above, to achieve the same advantages.

Thus, the present invention enables calibration, control and consistency with respect to movement of a screen holding arm carrying frames of various sizes and weights in a simple and accurate manner not previously available in the screen printing trade.

Other objects and advantages of the subject invention will become apparent with the detailed description of the invention which follows.

DETAILED DESCRIPTION OF THE INVENTION

Figure 1:
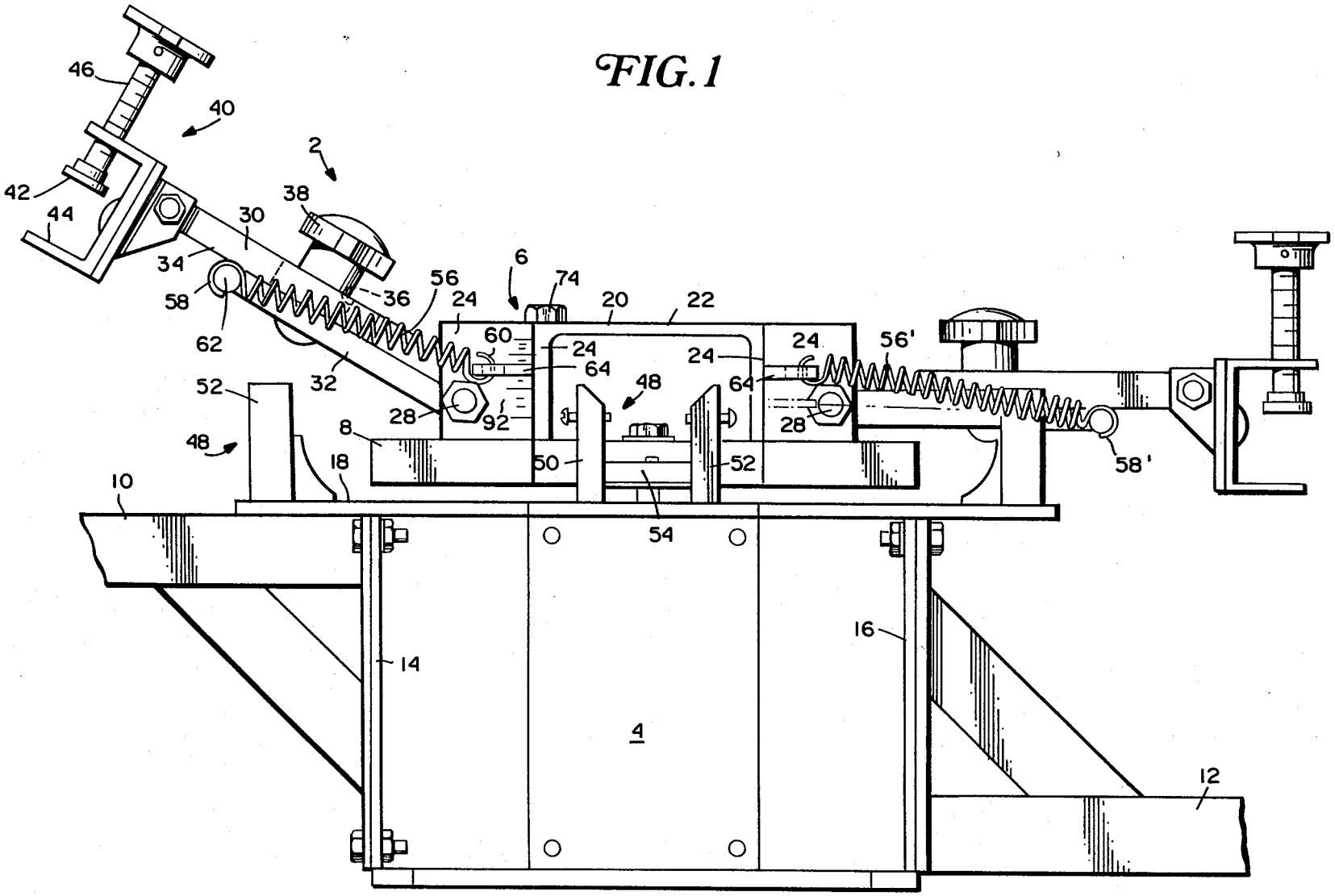
FIG. 1 is a partial side view of a four color screen printing device in accordance with an exemplary embodiment present invention with certain parts removed for clarity.
Figure 2:
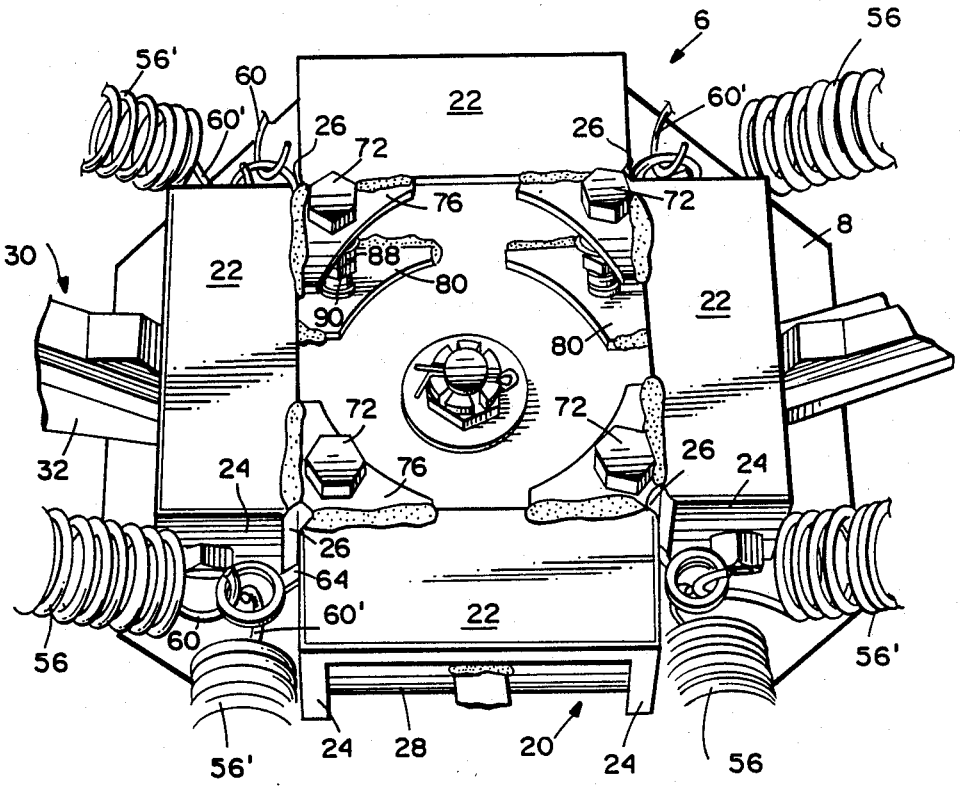
FIG. 2 is a partial perspective view of the rotary head portion of the screen printing device as illustrated in FIG. 1.

Referring now to FIG. 1 and 2, a four color screen printing machine 2 is illustrated and includes a base structure or frame 4, and a head 6 mounted on a manually rotatable turntable 8. Platen support arms 10 and 12 are mounted on vertical wall surfaces 14, 16 on opposite sides of the base 4 and two additional platen support arms (not shown) may be mounted perpendicularly with respect to support arms 10 and 12 to form a four color printing device with four work stations fixedly mounted at 90° intervals about the base 4. It will be understood that the base of the machine, the manner in which the turntable 8 is rotatably mounted on the top surface 18 of the base 4, and the details of the platen support arms 10 and 12 form no part of this invention and need not be described further.

The head 6 is made up of four identical, inverted U-shaped channel members, the description of one of which suffices for all. The channels 20 each include a top surface 22 and a pair of vertical walls 24 depending therefrom. It will be understood that each channel may be a single piece of metal bent or forged in a channel shape, or it may be a three piece assembly welded together as will be understood by those of ordinary skill in the art. The channels are so positioned on the turntable 8 as to define a substantially hollow central housing, and wherein narrow slots 26 are formed between adjacent channel members at the four corners of the housing.

Pivotally mounted to the head 6 by pivot pins 28 are four screen, i.e., screen frame holding arms 30, mounted at 90° intervals about the head 6 so that any given time, four separate operations may be performed, one at each of the four platens mounted on the platen support arms. For example, a four color image may be printed on an item of sportswear, such as cap, with one color being applied at each station. Alternatively, a single color image may be applied to a different item at each station. Since each of the screen holding arms is identical to the next, only one need be described herein in detail.

Referring specifically to the screen holding arm 30 mounted on the left hand side of the machine illustrated in FIG. 1, it will be seen that the arm is pivotally mounted by the pivot pin 28 which extends horizontally through side walls 24 of the associated channel member 20. The arm 30 includes an inner section 32 and an outer section 34 which are slidable with respect to each other, and adjustable by reason of a slot 36 formed in outer section 34, and an adjustment bolt 38 to effectively shorten or lengthen the screen holding arm, so as to enable precise alignment of the arm with respect to a platen on the support arm 10. At the far end of the outer section 34, there is mounted a screen frame clamp 40 which includes a movable jaw 42 and a fixed jaw 44. Movable jaw 42 is part of an adjustable screw 46. The particular details of the screen clamp are well known in the art and need not be further described.

A guide/stop 48 is provided for the screen holding arm 30 on the horizontal top frame surface 18 of the base 4. The guide/stop includes spaced, vertical wall sections 50, 52 and a cross-piece 54 to form a substantially U-shaped cradle for receiving an associated screen holding arm generally aligned therewith.

A pair of coil extension springs 56, 56' are mounted on either side of the screen holding arm 30, each spring be provided with a first attachment hook 58, 58' and a second attachment hook 60, 60', respectively. The first attachment hooks, 58, 58' are affixed to a rod 62 which extends substantially perpendicular to the arm 30 and which is fixedly secured as by welding to the outer edge of the inner arm section 32. The second attachment hooks 60, 60' are attached to an adjustable spring connector 64 as further described hereinbelow.

Figure 3:
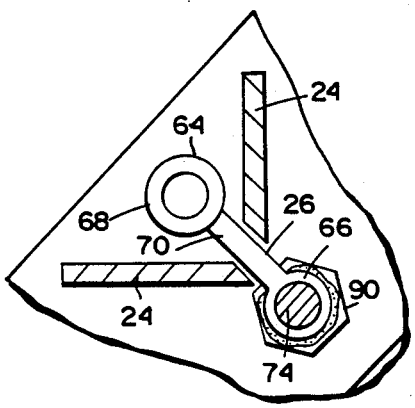
FIG. 3 is a partial top sectional view taken along the line 3—3 of FIG. 4 and showing a spring connector in accordance with the invention.
Figure 4:
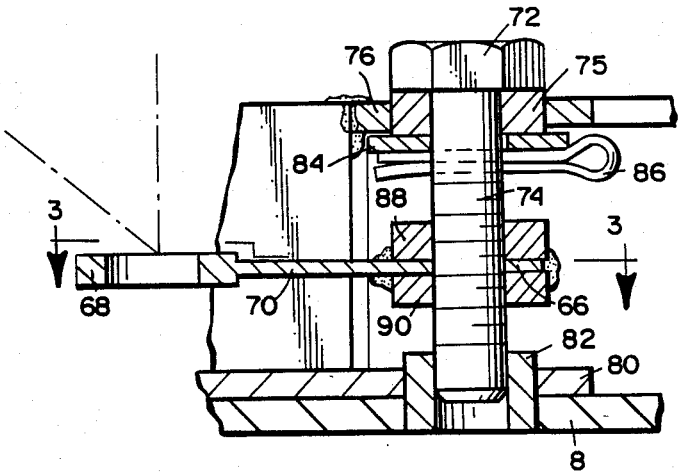
FIG. 4 is a partial cross-sectional view illustrating a spring connector and adjusting bolt in accordance with the invention.

With particular reference to FIGS. 3 and 4, each adjustable spring connector 64 includes a first or inner eyelet 66, a second or outer eyelet 68 and an intermediate throat portion 70. Referring back to FIGS. 1 and 2, it will be appreciated that second attachment hooks 60, 60' of springs 56, 56', respectively, are attached to the outer eyelets 68 of the adjustable connectors 64. The inner eyelet portion 66 of each connector 64 is slidably mounted over a partially threaded bolt 72, having a shank 74 which is slidably received in a smooth bore bushing 75 press fit in an upper gusset 76 extending between top surfaces of adjacent channels 20. The lower end of the bolt is received in a bushing 82 press-fit into a lower gusset 80 provided on the base of the turntable 8.

In an exemplary embodiment, bushings 75, 82 are made of steel, while gussets 76 and 80 are constructed of aluminum. Preferably, bolt 72 is stripped of its threads in the areas which engage the upper and lower bushings, to provide minimal frictional engagement therebetween. It will be understood that the steel bushings prevent wear and possibly enlargement of the holes provided in the otherwise relatively soft aluminum gussets. It will be understood that other suitable materials may also be used.

The bolt 72 is also provided with a smooth shank surface just below the gusset 76 for reception of a washer 84, along with a cross bore for receiving an associated cotter key or pin 86 which serve to constrain the bolt for rotary motion, without permitting any substantial axial movement. Any other suitable means may be employed to hold the bolt against axial movement, such as C-clips and the like.

The inner eyelet 66 of the adjustable connector 64 is slidably received over the threaded portion of the bolt 72 and sandwiched between a pair of nuts 88, 90. These nuts may be brazed to the inner eyelet 66 and, since the adjustable connector 64 is itself prevented from rotating by reason of its passage through the slot 26 formed between adjacent housing channels of the rotary head, rotation of the bolt 72 will result in upward or downward movement of the adjustable connector 64, depending on the direction of rotation of the bolt. Thus, by rotating the bolt 72, the point of attachment of the springs 56, 56' with respect to the pivot pin 28 may be altered between positions above, at or below a plane passing through the pivot pin 28.

With reference now to FIG. 1, it may be seen that the attachment points of spring 56 including rod 62 and connector 64, and the pivot pin 28 which mounts the arm 30, are interrelated in a manner which substantially affects the tension in the arm 30, and therefore, the ease or difficulty with which arm 30 is raised and lowered between printing and non-printing positions. For example, for normal frames, when the screen holding arm is in the down position, the operator can take his hands off the screen so long as the point of attachment of the spring to the machine head, as determined by the location of connector 64, is in the same plane, or close to the same plane, as the other two attachment points. If, on the other hand, connector 64 were substantially above the pivot pin 28, the arm would automatically rise upon release by the operator in the down position. Assuming again that connector 64 is generally within the plane of pin 28, it will be understood that when the screen printing operator lifts the arm a few inches, the fully extended spring starts to close, thereby reducing the spring rate. At the same time, however, an angle opens up between the arm and the spring, creating leverage. As the arm is raised further, more leverage is created while the spring rate drops even further. When the arm is in its fully lowered or printing position, the spring rate is at its maximum but there is no leverage with which to raise the screen. It is this combination of leverage and spring rate which allows the arm to remain in raised and lowered positions without some restraint exerted by the operator.

As can be readily seen in FIG. 1, rotation of bolts 72 will alter the configuration of attachment points of the spring and the pivot pin of the arm. In the solid line configuration of FIG. 1, the springs 56 and 56' associated with oppositely extending arms 30 are shown to be slightly above the horizontal plane extending through pivot pin 28. In the phantom position shown on the right hand side of the machine, connector 64 has been adjusted so that the spring 56' is connected to the machine head at a point generally within the plane of the pivot pin 28.

As earlier stated, optimal positions for the extension springs relative to the pivot points of the screen holding arms can be determined empirically, with the aid of scales, such as shown at 92 in FIG. 1. In this way, predetermined adjustments may be made for virtually any size or weight screen, saving the operator significant amounts of time and effort.

In general, it has been found that proper arm tension and movement control is achieved when connector 64 is slightly below the horizontal plane of the pin 28. For heavier, oversize frames, movement of connector 64 into or just above the plane of the pin 28 provides the desired degree of tension and control. Specific adjustments for specific frames may vary, of course, according to size and weight of the frames.

Figure 5:
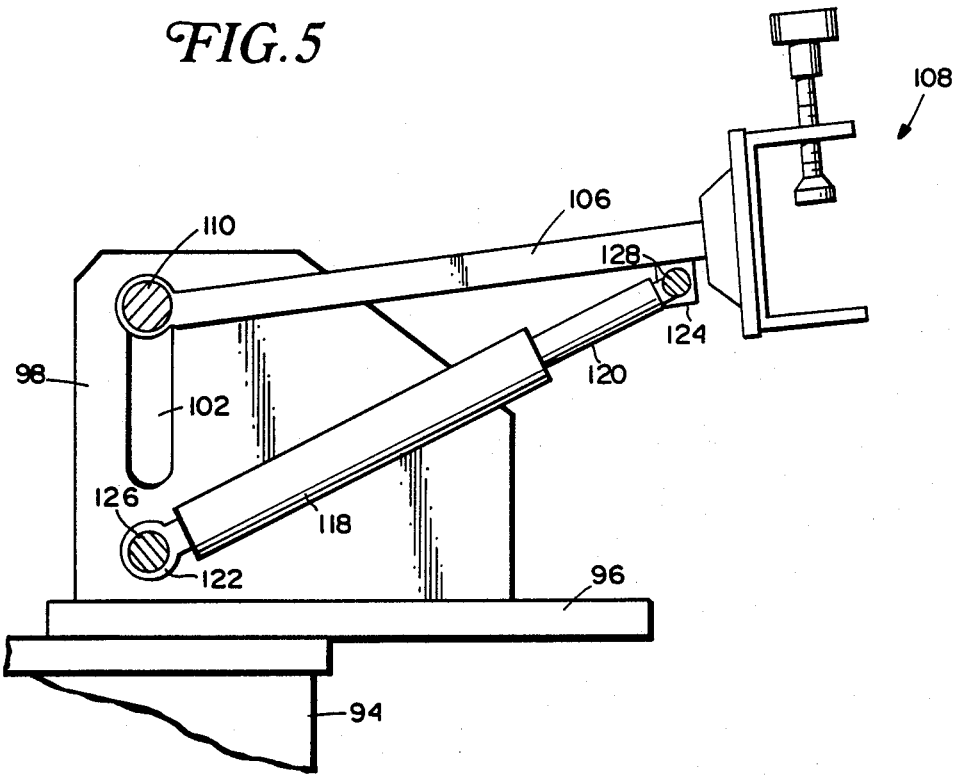
FIG. 5 is a partial side elevation of a screen printing device in accordance with another exemplary embodiment of the invention.
Figure 6:
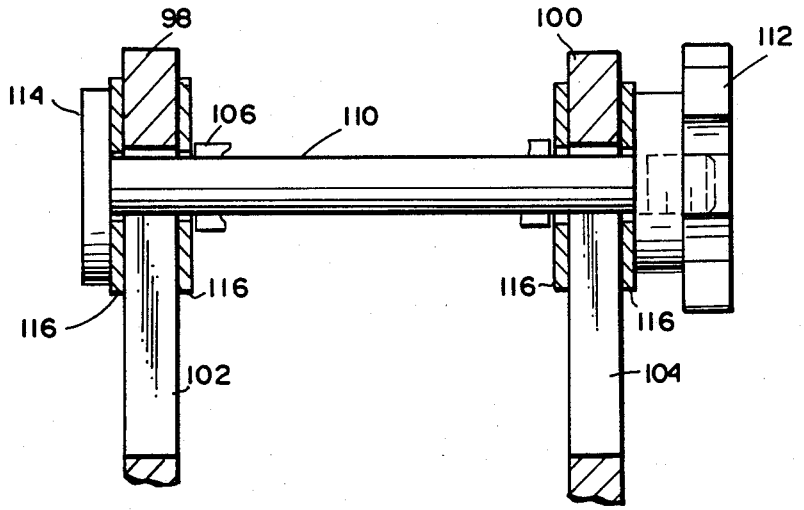
FIG. 6 is a partial rear view of the device illustrated in FIG. 5.

With reference now to FIGS. 5 and 6, an alternative exemplary embodiment of the invention will be described, wherein one or more compression gas cylinders may be used with a screen printing machine of the single or multiple head type. On the machine head 94, there is mounted a base plate 96 which supports a pair of upstanding and substantially parallel plates 98, 100. The plates are formed with respective vertically oriented slots 102, 104 which provide for adjustable mounting of the screen printing arm 106. The arm 106 has a jaw structure 108 similar to that described with respect to the embodiment illustrated in FIG. 1, the details of which need not be repeated. The rearward end of the arm 106 is provided with a pivot pin 110 slidably received in the slots 102, 104. A rotatable adjustment knob 112 is threadably received on one end of the pin 110 which, in turn, is provided with an enlarged head 114 at the end remote from the adjustment knob 112. In addition, two sets of washers 116, preferably of the nylon type, are inserted on either side of the upstanding plates 98, 100 between surfaces of the respective plates and enlarged head 114, arm 106, and the knob 112.

Insofar as knob 112 is threadably received on the pivot pin 110, it will be appreciated that by loosening the knob 112, the pin 110 as well as the screen holding arm 106 may be moved within the slots 102, 104 and, may be fixed at any position along the length of the slots by tightening the knob 112.

A cylinder 118 and associated piston 120 is fixedly mounted between the upstanding plates 98, 100, and a tab 124 which depends from the arm 106. An eyelet 122 connected to the rearward end of cylinder 118 is permitted to rotate about a pivot pin 126 which extends between the plates 98, 100, while the distal end of piston 120 is able to rotate about a pin 128 which extends through the tab 124.

From the above, it may be seen that the vertical distance between pivot pin 110 of the screen holding arm 106 may be moved toward or away from the pivot pin 126 of the piston and cylinder arrangement. This, of course, creates the same adjustment to "spring rate" and leverage available to move the screen holding arm 106 between its printing and non-printing positions as described above with respect to the FIG. 1 embodiment. In this regard, it will be appreciated that a scale may be provided on the exterior surface of one or both of the upstanding plates 98, 100 so that the screen holding arm 106 may be moved to various predetermined positions in accordance with frame size and weight as also described above.

This arrangement, of course, may also be applied to four station machines where four screen holding arms 106 are mounted to a single machine head.

In addition, it will be understood that in place of the gas compression cylinder and piston arrangements, compression springs may be fixedly mounted between, for example, the base plate 96 and screen holding arm 106. Adjustments to the rearward pivot attachment of the screen holding arm 106 relative to the plates 98, 100, would achieve the same advantageous adjustability features described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. In a screen printing machine including a head and at least one screen frame holding arm pivotally mounted on said head for movement about an axis toward and away from a platen to lowered printing and raised non-printing positions, respectively, and including spring means associated with said at least one arm, said spring means attached at one end to first attachment means located on said at least one arm and at another end to second attachment means located on said head for controlling the movement of said at least one arm; the improvement comprising means for adjusting the spring rate of said spring means and for creating varying degrees of leverage to facilitate movement of said arm toward and away from said platen, such that said spring means alone will maintain the arm in the lowered printing position and in the raised non-printing position.

2. A screen printing machine as defined in claim 1 wherein said adjusting means includes means for altering the location of said second attachment means relative to a horizontal plane containing said axis.

3. A screen printing machine as defined in claim 2 wherein said spring means includes at least one pair of coil extension springs, one on either side of said at least one arm.

4. A screen printing machine as defined in claim 2 wherein said spring means comprises at least one compression gas cylinder.

5. A screen printing machine as defined in claim 4 wherein said altering means moves said axis toward and away from said second attachment means.

6. A screen printing machine as defined in claim 5 wherein said altering means includes a pair of upstanding, laterally spaced plates, said gas cylinder mounted to a first pivot pin fixed for rotation between said plates, and said screen holding arm mounted for pivotal movement about a second pivot pin mounted for substantially vertical sliding movement between said plates.

7. In a screen printing machine including a base, a rotary head mounted on said base, a plurality of arms extending radially outwardly from said rotary head, each arm having a screen frame holder mounted at its distal end, wherein said rotary head is indexable to a plurality of printing platens and wherein each arm is mounted for pivotal movement toward and away from said platens about a horizontal axis; spring means associated with each arm, said spring means extending from a first attachment means on said arm to a second attachment means on said head, and means associated with each arm for simultaneously adjusting the spring rate of said spring means and leverage available for moving each of said arms toward and away from said platens to thereby facilitate uniform movement of each of said arms substantially independently of screen frame size and weight, and to cause said arms to remain raised when raised to a non-printing position, and to remain lowered when lowered to a printing position.

8. The screen printing machine as defined in claim 7 wherein said adjusting means comprises means for moving said second attachment means vertically relative to said horizontal axis.

9. The screen printing machine as defined in claim 8 wherein said spring means comprises a pair of extension springs associated with each arm.

10. The screen printing machine as defined in claim 8 wherein said spring means comprises at least one compressible gas cylinder associated with each arm.

11. The screen printing machine as defined in claim 10 wherein said moving means moves said axis toward and away from said second attachment means.

12. The screen printing machine as defined in claim 11 wherein said altering means includes a pair of upstanding, laterally spaced plates, said gas cylinder mounted on a first pivot pin fixed for rotation between said plates, said screen holding arm mounted for pivotal movement about a second pivot pin mounted for adjustable, substantially vertical sliding movement between said plates and above said first pivot pin.

13. The screen printing machine as defined in claim 12 wherein said second pivot pin is slidably received in a pair of laterally aligned, substantially vertically oriented slots formed in said plates.

14. In a screen printing machine, an adjustment mechanism for altering the spring rate of an extension spring extending between a printing head and a screen holding arm mounted to said head for pivotal movement about a horizontal axis of rotation between raised non-printing and lowered printing positions, said adjustment mechanism comprising means for varying in a substantially vertical direction the location of a connector to which an end of the spring closest the head is attached, relative to a horizontal plane containing said horizontal axis of rotation, to thereby enable said spring to maintain said screen holding arm in said raised non-printing and lowered printing positions.

15. An adjustment mechanism as defined in claim 14 wherein said connector has a first end for receiving said end of said spring, and a second end captured for substantially vertical sliding movement along a threaded bolt, whereby rotation of said bolt causes said connector to move relative to said axis of rotation.

16. An adjustment mechanism as defined in claim 15 wherein said axis of rotation is substantially horizontal and said bolt is arranged substantially perpendicular thereto.

17. An adjustment mechanism as defined in claim 15 wherein rotation of said bolt also causes variation in the amount of leverage available to facilitate movement of said arm.

18. An adjustment mechanism for a screen printing device comprising at least one screen printing arm adapted to hold a screen frame and pivotally mounted to a screen printing head for rotation about a first substantially horizontal axis between raised non-printing and lowered printing positions, said device comprising spring means extending between a first attachment means on said arm and a second attachment means on said head, said adjustment mechanism comprising means for moving one of said first substantially horizontal axis and said second attachment means vertically toward or away from the other to facilitate substantially uniform movement of said screen printing arm toward and away from said screen printing head substantially independently of screen frame size and weight, said spring means acting to hold said screen printing arm in said raised and lowered positions when moved to said positions by a user.

19. In a method for adapting a screen printing machine to accommodate screen frames of various sizes and weights, said screen printing machine including a head, and at least one screen frame holding arm pivotally mounted on said head for movement about an axis toward and away from a platen to lowered printing and raised non-printing positions, and including a pair of coil extension springs associated with said at least one arm, wherein said springs are arranged on opposite sides of said arm and are attached at outer ends to first attachment points on said at least one arm and at inner ends to second attachment points on said head for controlling the movement of said at least one arm, the improvement comprising the step of:

(a) vertically adjusting the second attachment points of said extension springs relative to a horizontal plane containing said axis in accordance with the size and weight of the screen frame utilized with the machine, to achieve uniform arm movement and to insure that the arm will remain lowered when moved to the lowered printing position, and remain raised when moved to the raised non-printing position.

20. A method for adapting a screen printing machine to accommodate screen frames of various sizes and weights, said screen printing machines including a head, and at least one screen frame holding arm pivotally mounted on said head for movement about a horizontal axis toward and away from a platen, and including a pair of coil extension springs associated with said at least one arm, wherein said springs are arranged on opposite sides of said arm and are attached at outer ends to first attachment points on said at least one arm and at inner ends to second attachment points on said head for controlling the movement of said at least one arm, the method comprising the steps of:

(a) providing means for adjusting the spring rate of said extension springs and for adjusting the leverage available to raise or lower the screen frame holding arm;

(b) providing a numerical scale on said head for indicating the degree of adjustment which may be effected by said means; and (c) calibrating adjustment levels for screen frames of various sizes and weights which will insure that, for each screen, the screen frame holding arm will remain, unassisted, in a raised, non-printing position when moved thereto, and which will remain unassisted, in a lowered, printing position when moved thereto.

21. A method as defined in claim 20 wherein said machine is provided with a plurality of said screen frame holding arms and wherein step (c) is carried out with respect to each of said plurality of arms.

22. In a method for adapting a screen printing machine to accommodate screen frames of various sizes and weights, said screen printing machine including a head, and at least one screen frame holding arm pivotally mounted on said head for movement about an axis toward and away from said platen, a lower printing and raised non-printing positions, respectively, and including spring means extending between a first attachment means on said at least one arm and a second attachment means on said head for controlling the movement of said at least one arm, the method comprising the step of:

(a) moving said second attachment means to a position above or below said axis, depending on screen frame size and weight to thereby facilitate uniform movement of said screen frame holding arm, and to insure that said screen frame holding arm will remain raised to said non-printing position, and remain lowered when moved to said printing position.

23. In a screen printing machine including a head and at least one screen holding arm pivotally mounted on said head for movement about an axis toward and away from a platen, and further including at least one pair of coil extension springs, one on either side of said at least one arm, each of said coil extension springs attached at one end to first attachment means on said at least one arm and at another end to second attachment means on said head for controlling the movement of said at least one arm;

means for adjusting the spring rate of said at least one pair of coil extension springs and for creating varying degrees of leverage to facilitate movement of said arm toward and away from said platen, and wherein said second attachment means each include a connector comprising a pair of spaced eyelet portions connected by an elongate throat portion, an outer one of said eyelets adapted to receive the inner end of one of said extension springs, and an inner one of said eyelets adapted to receive said adjusting means.

24. A screen printing machine as defined in claim 23 wherein said adjusting means comprises a bolt.

25. A screen printing machine as defined in claim 24 wherein said bolt is rotatably mounted substantially vertically in said head, the inner of said eyelets being sandwiched between a pair of nut elements threadably received on said bolt, said nut elements constrained against rotation so that, upon rotation of said bolt, said nut elements and said connector move vertically relative to said bolt.

26. A screen printing machine as defined in claim 25 wherein said bolt is constrained against substantial axial movement within said head.

27. A screen printing machine as defined in claim 23 wherein four screen holding arms are pivotally mounted at substantially 90° intervals about said head, and wherein four of said connectors are provided, and respective outer ones of said eyelets are adapted to receive the inner end of an extension spring associated with each of two adjacent screen holding arms.

28. In a screen printing machine including a base, a rotary head mounted on said base, a plurality of arms extending radially outwardly from said rotary head, each arm having a screen holder mounted at its distal end, wherein said rotary head is indexable to a plurality of printing platens and wherein each arm is mounted for pivotal movement toward and away from said platens about a horizontal axis; spring means including a pair of extension springs associated with each arm, each of said extension springs extending from a first attachment means on said arm to a second attachment means on said head, said second attachment means each including a connector comprising a pair of spaced eyelet portions connected by an elongated throat portion, an outer one of said eyelets adapted to receive the inner end of one of said extension springs, and an inner one of said eyelets adapted to receive said rotatable means, and adjustment means associated with each arm for simultaneously adjusting the spring rate of said extension springs and leverage available for moving each of said arms toward and away from said platens, said adjustment means comprising means for moving said second attachment means vertically relative to said horizontal axis.

29. The screen printing machine as defined in claim 28 wherein said adjustment means comprises a pair of bolts associated with each of said arms.

30. The screen printing machine as defined in claim 29 wherein each of said bolts is rotatably mounted substantially vertically in said head, the inner eyelet of each connector being sandwiched between a pair of nut elements threadably received on each of said bolts, said nut elements constrained against rotation so that upon rotation of said bolts, said nut elements and said connectors move vertically relative to said bolts.

31. The screen printing machine as defined in claim 30 wherein said bolts are constrained against substantial axial movement within said head.

* * * * *